US009493910B2

(12) United States Patent
Lin

(10) Patent No.: US 9,493,910 B2
(45) Date of Patent: Nov. 15, 2016

(54) CORRUGATED PAPER FORMING MACHINE WITH NUMERICAL MOTOR SPEED CONTROL

(71) Applicant: Tzu-Che Lin, Taoyuan County (TW)

(72) Inventor: Tzu-Che Lin, Taoyuan County (TW)

( * ) Notice: Subject to any disclaimer, the term of this patent is extended or adjusted under 35 U.S.C. 154(b) by 6 days.

(21) Appl. No.: 14/594,798

(22) Filed: Jan. 12, 2015

(65) Prior Publication Data

US 2016/0201263 A1 Jul. 14, 2016

(51) Int. Cl.
*D21G 9/00* (2006.01)
*D21F 7/00* (2006.01)

(52) U.S. Cl.
CPC ..... *D21F 7/00* (2013.01)

(58) Field of Classification Search
CPC ..... D21G 9/00; D21F 7/02
USPC ..... 162/256
See application file for complete search history.

(56) References Cited

U.S. PATENT DOCUMENTS 2,680,996 A * 6/1954 Brown ..... D21J 3/00 162/296
2,714,340 A * 8/1955 Brown ..... D21F 11/12 118/216
RE24,361 E * 9/1957 Brown ..... B65D 65/403 162/117
3,947,206 A * 3/1976 DeLigt ..... B29C 53/285 156/210
3,972,763 A * 8/1976 Wolvin ..... B31F 1/2804 156/210
4,240,871 A * 12/1980 Burkhart ..... D21F 1/60 162/274
4,999,086 A * 3/1991 Marx, Jr. ..... D21F 1/40 162/209

FOREIGN PATENT DOCUMENTS

EP 0025759 * 9/1979

OTHER PUBLICATIONS

EP-0025759, Berthelot et al., Sep. 1979, machine translation.*

* cited by examiner

*Primary Examiner* — Mark Halpern
(74) *Attorney, Agent, or Firm* — Muncy, Geissler, Olds & Lowe, P.C.

(57) ABSTRACT

A corrugated paper forming machine includes ramming rollers for ramming a paper material into a corrugated paper having flute design, each ramming roller including longitudinal teeth equiangularly spaced around the periphery thereof, a plurality of air suction grooves located in the periphery, a ventilation unit formed of a plurality of air outlets and located in one end thereof and air suction holes located in the air suction grooves in communication with the air outlets, a motor operated suction device for drawing air out of the ramming rollers to cause generation of a suction force in the air suction grooves, a control module, a sensor circuit for sensing operation conditions of the supplied paper material providing detected numerical data to the control module to regulate the speed of the suction motor in changing the level of suction force.

4 Claims, 5 Drawing Sheets

CORRUGATED PAPER FORMING MACHINE WITH NUMERICAL MOTOR SPEED CONTROL

BACKGROUND OF THE INVENTION

1. Field of the Invention

The present invention relates to paper product manufacturing technology and more particularly, to a corrugated paper forming machine with numerical motor speed control, which uses a suction motor of a motor operated suction device to draw air out of the ramming rollers for causing generation of a suction force in air suction grooves of the ramming rollers to suck up the paper material, enables a sensor circuit to detect the operation conditions of the paper material and to provide the detected numerical data to a control module for controlling the speed of the suction motor to regulate the speed of the suction motor in changing the level of suction force.

2. Description of the Related Art

At the present time, the manufacturing industry is facing labor shortages and rising awareness of environmental protection, rising of labor and operating costs and pressure of transition of labor-intensive nature of manufacturing into technology-intensive nature of manufacturing, so manufacturers need to employ production line automation technology and facility to achieve reduction in manpower, saving of working hours and increase of productivity. In paper materials, corrugated paper has the advantages of printing convenience, sturdy and durability. Further, the flexibility and shock absorbing functions of the wave-like structure of the internal lamination of corrugated paper are the unmatched features not found in other paper materials. Therefore, corrugated paper is widely used for making packing cartons and boxes for packing different products to protect packed items against impact damage and to facilitate storage and delivery.

The fabrication of a corrugated paper includes the steps of paper splicing, pre-heating, fluted shape forming, gluing, cooling, line pressing, trimming, cutting-off and laminating. During the fabrication of a corrugated paper, paper material is delivered by a conveyor into the corrugated paper forming machine and rammed into a fluted paper having a flute design by ramming rollers, and then glued by a glue dispenser, and then bonded to a face paper by impression rollers to form a single-sided (single face) corrugated paper. Prior to bonding between the fluted paper and the face paper, the fluted paper is delivered through flute-shaped wheels and impression rollers and pre-heated by a heat source such as steam boiler, infrared lamp or hot plate. However, because the wheels and rollers of the corrugated paper forming machine are rotated at a speed as high as several meters per minute, a centrifugal force can be produced to bias the supplied paper material, leading to breakage or cracking of the supplied paper material, and affecting the effect of bonding between the rammed fluted paper and the face paper.

In order to solve the aforesaid problem, an improved design of corrugated paper forming machine was created. According to this design, the ramming roller for ramming a paper material into a fluted paper has air suction grooves in the longitudinal teeth thereof, and a suction motor is provided for drawing air out of the ramming roller to create a suction force in the fluted paper for sucking up the feeding paper material for ramming. However, because a longitudinal gap exists between each two adjacent longitudinal teeth, the suction force thus created in unstable and cannot positively suck up the feeding paper material, leading to fluted paper quality instability and low yield rate. Further, the suction force created by the suction motor is directly proportional to the speed of the suction motor and determined subject to predetermined standard paper operation conditions (such as paper width, working temperature, speed, humidity, etc.). This prior art design does not allow regulation of the suction force subject to change of paper operation conditions, and thus, the suction motor consumes a large amount of electrical power during its operation, leading to high power consumption cost and frequent maintenance shutdowns, and shortening the lifespan of the suction motor. An improvement in this regard is necessary.

SUMMARY OF THE INVENTION

The present invention has been accomplished under the circumstances in view. It is therefore the main object of the present invention to provide a corrugated paper forming machine, which positively sucks up the supplied paper material by a suction force for accurately ramming into a fluted paper, avoiding breakage or cracking of the supplied paper material, and assuring a high level of ramming stability and integrity of the formation of the flute design on the paper material so that a high level of product quality and a high-yield production can be achieved.

To achieve this and other objects of the present invention, a corrugated paper forming machine of the invention comprises at least one ramming roller, motor operated suction device, a control module, and a sensor circuit. The at least one ramming roller is rotatable to ram a paper material into a fluted paper having flute design, each comprising a plurality of longitudinal teeth equiangularly spaced around the periphery thereof, a plurality of air suction grooves located in the periphery, a ventilation unit formed of a plurality of air outlets and located in one end thereof, and a plurality of air suction holes located in the air suction grooves in communication with the air outlets. The motor operated suction device comprises a suction motor connected with the ventilation unit and adapted for drawing air out of the at least one ramming roller to cause generation of a suction force in the air suction grooves. The control module is electrically coupled with the suction motor of the motor operated suction device. The sensor circuit is electrically coupled to the control module for sensing operation conditions of the paper material to be rammed by the ramming roller into a fluted paper, and providing detected numerical data to the control module to regulate the speed of the suction motor in changing the level of suction force. Thus, the suction force generated in the air suction grooves is optimally controlled, eliminating power waste and saving power cost.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
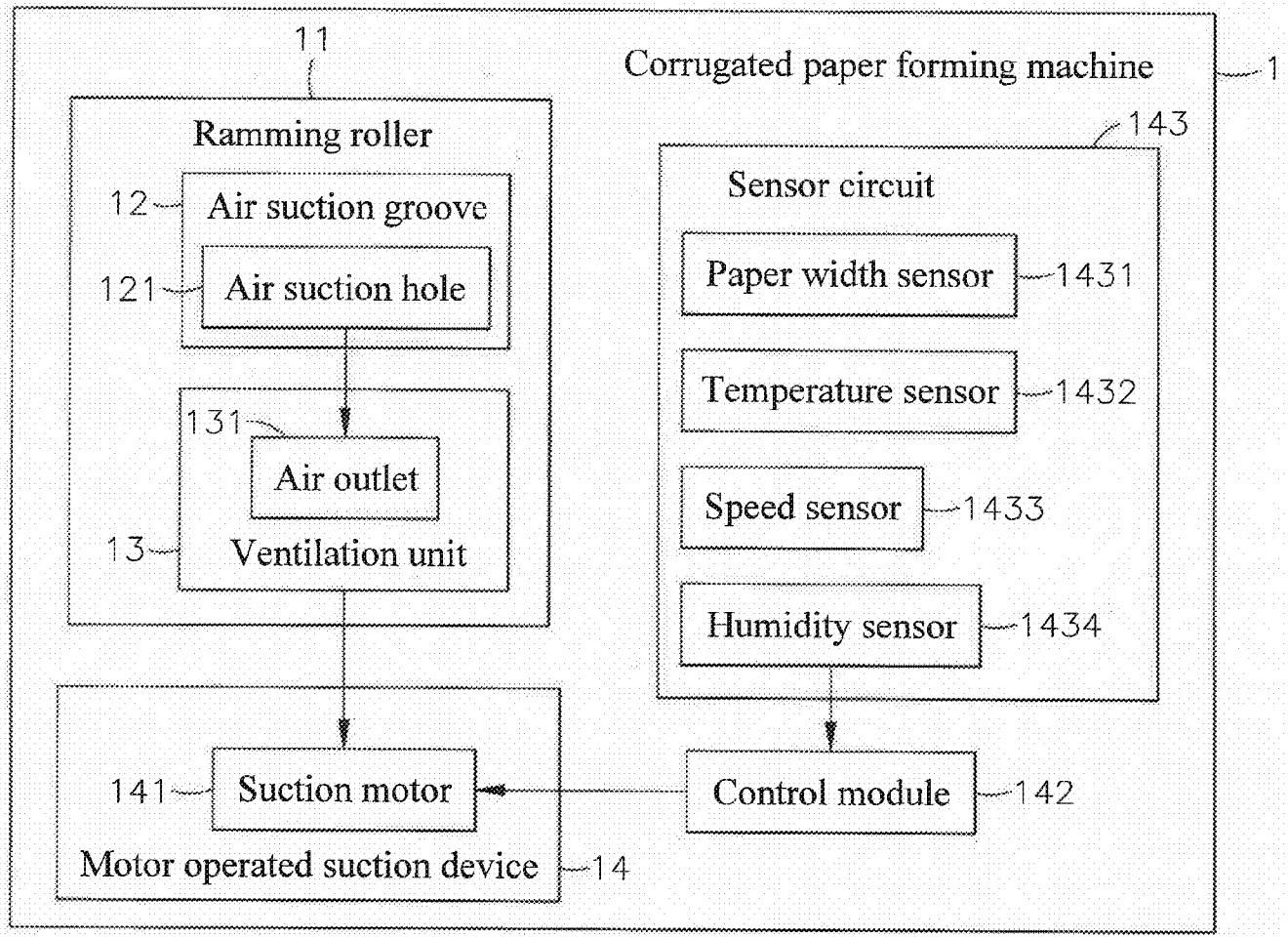
FIG. 1 is a system block diagram of a corrugated paper forming machine in accordance with a first embodiment of the present invention.
Figure 2:
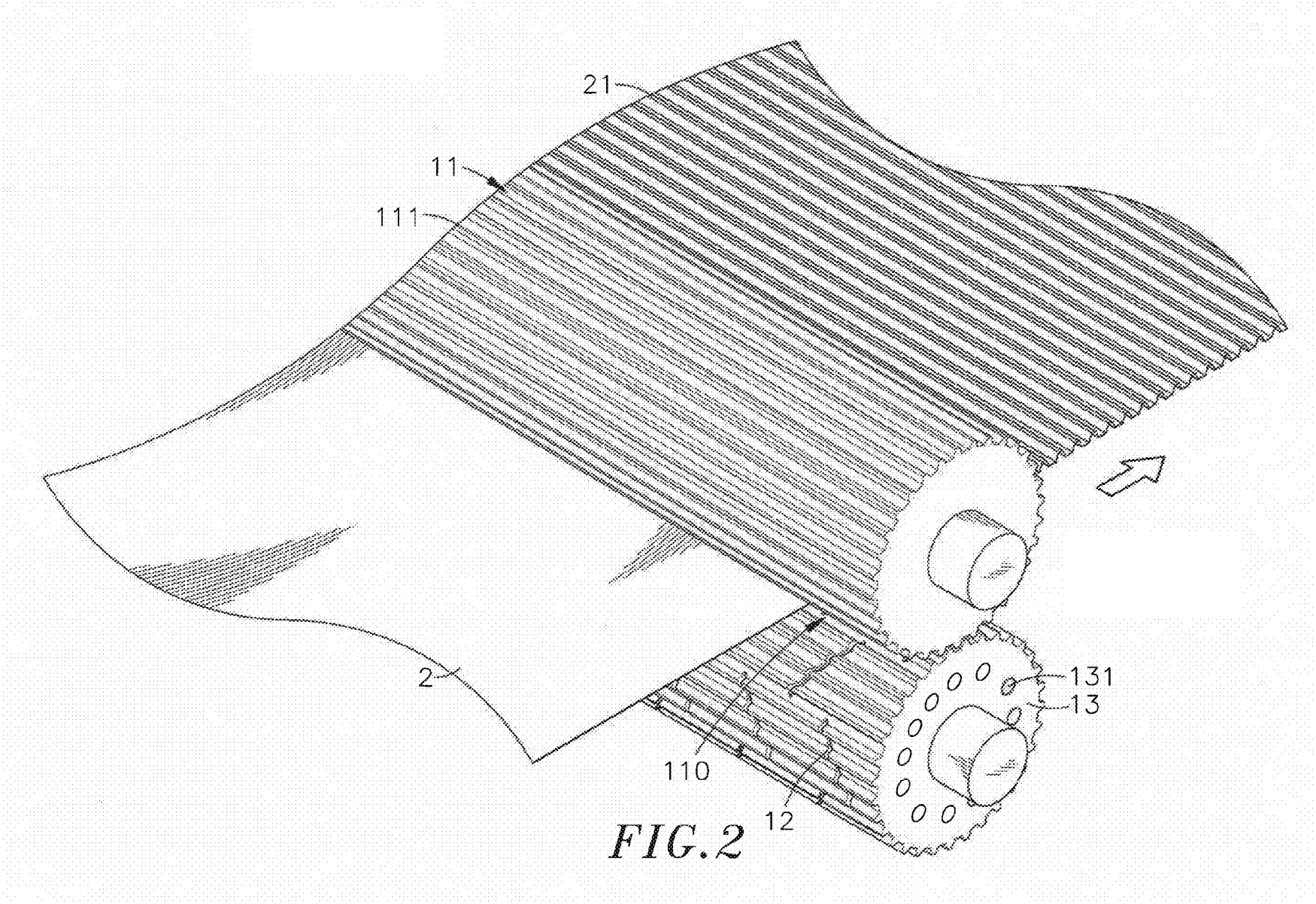
FIG. 2 is a schematic drawing illustrating a paper material delivered through the ramming rollers of the corrugated paper forming machine and rammed into shape in accordance with the first embodiment of the present invention.
Figure 3:
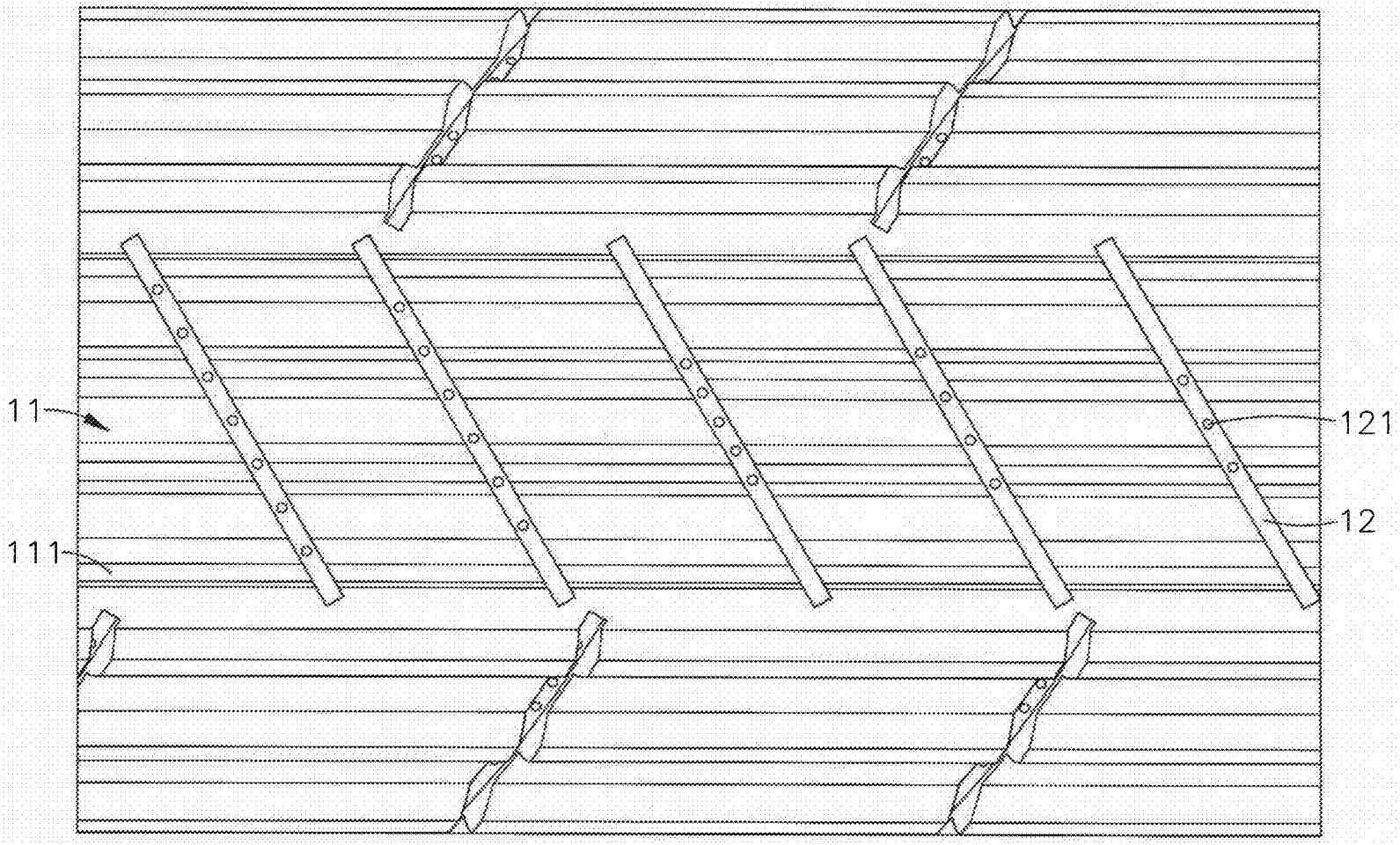
FIG. 3 is an enlarged view of a part of one ramming roller of the corrugated paper forming machine in accordance with the first embodiment of the present invention.

Referring to FIGS. 1-3, a system block diagram of a corrugated paper forming machine in accordance with a first embodiment of the present invention, a schematic drawing illustrating a paper material delivered through ramming rollers of the corrugated paper forming machine and rammed into shape in accordance with the first embodiment of the present invention and an enlarged view of a part of one ramming roller of the corrugated paper forming machine in accordance with the first embodiment of the present invention are shown. As illustrated, the corrugated paper forming machine 1 comprises at least one, for example, two ramming rollers 11 arranged in a parallel manner in proximity to each other with a gap 110 left therebetween for the passing of a paper material 2, enabling the applied paper material 2 to be rammed by the ramming rollers 11 to provide a flute design 21. The ramming rollers 11 can be fluted rollers, pressure rolls, guide wheels, etc. In this embodiment, the ramming rollers 11 are fluted rollers, each comprising a plurality of longitudinal teeth 111 equiangularly spaced around the periphery thereof, a plurality of air suction grooves 12 located in the periphery and respectively extending across the longitudinal teeth 111, a ventilation unit 13 formed of a plurality of air outlets 131 and located in one end thereof, and a plurality of air suction holes 121 located in the air suction grooves 12 in communication with the air outlets 131. The corrugated paper forming machine 1 further comprises a motor operated suction device 14 connected with the ventilation unit 13, a control module 142 electrically coupled with the suction motor 141 of the motor operated suction device 14, and a sensor circuit 143 electrically coupled to the control module 142 for sensing the operation conditions of the applied paper material 2 and providing detected numerical data to the control module 142 to regulate the speed of the suction motor 141 in changing the level of suction force.

Preferably, the air suction grooves 12 are arranged in oblique rows and spaced around the periphery of each ramming roller 11 in a staggered manner and respectively obliquely extending across respective longitudinal teeth 111. Further, the air suction holes 121 in the air suction grooves 12 in each ramming roller 11 are arranged in a line. Further, the spacing between each two adjacent air suction holes 121 in each air suction groove 12 of each ramming roller 11 is gradually increased in direction from the middle part of each ramming roller 11 toward the two opposite ends thereof. Further, the air suction holes 121 can be configured to have one same diameter. Alternatively, the air suction holes 121 can be configured to have different diameters. During operation of the motor operated suction device 14, the suction motor 141 is rotated to draw air out of the air outlets 131 of the ventilation unit 13 of each ramming roller 11, causing generation of a suction force in the air suction holes 121 in the air suction grooves 12 to suck up the paper material 2. Because the spacing between each two adjacent air suction holes 121 in each air suction groove 12 of each ramming roller 11 is gradually increased in direction from the middle part of each ramming roller 11 toward the two opposite ends thereof, the suction force produced in the middle part of each ramming roller 11 is relatively larger than that around each end area of each ramming roller 11, so that the paper material 2 can be positively sucked up by the suction force and maintained in a certain degree of tension, avoiding breakage or cracking of the paper material 2, and assuring a high level of ramming stability and integrity of the formation of the flute design 21 on the paper material 2. Thus, high level of product quality and high-yield production can be achieved.

Further, the sensor circuit 143 of the motor operated suction device 14 comprises a paper width sensor 1431, a temperature sensor 1432, a speed sensor 1433 and a humidity sensor 1434. In actual application, the types and amount of the sensors of the sensor circuit can be changed to meet different requirements. The control module 142 receives numerical sensing data from the paper width sensor 1431, temperature sensor 1432, speed sensor 1433 and humidity sensor 1434 of the sensor circuit 143 for computing the operation conditions of the paper material 2 (such as paper width, working temperature, speed, humidity, etc.) and comparing the calculated results with built-in reference data. For example, the standard parameter values can be: paper width 2.5 m, working temperature 100° C., production speed or machine speed 120 m/min, and humidity 5%. Thus, the control module 142 can control the suction motor 141 to maintain the standard speed, for example, 1200 rpm, or to change the speed subject to the comparison results. Further, a display module (not shown) is electrically connected to the control module 142 for displaying numerical data so that the user can know the current operation status on the real time.

Figure 4:
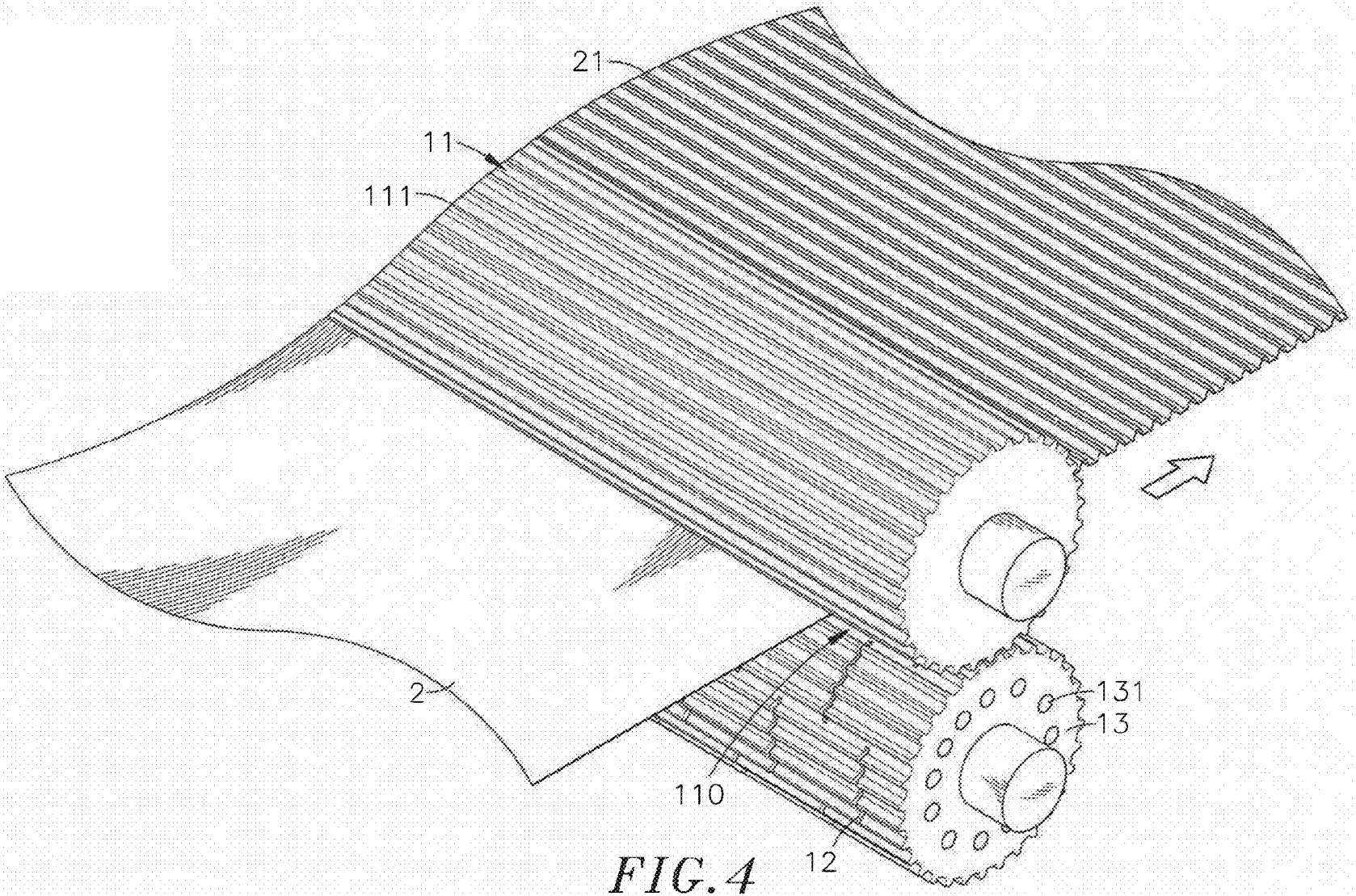
FIG. 4 is a schematic drawing illustrating a paper material delivered through two ramming rollers of a corrugated paper forming machine and rammed into shape in accordance with a second embodiment of the present invention.
Figure 5:
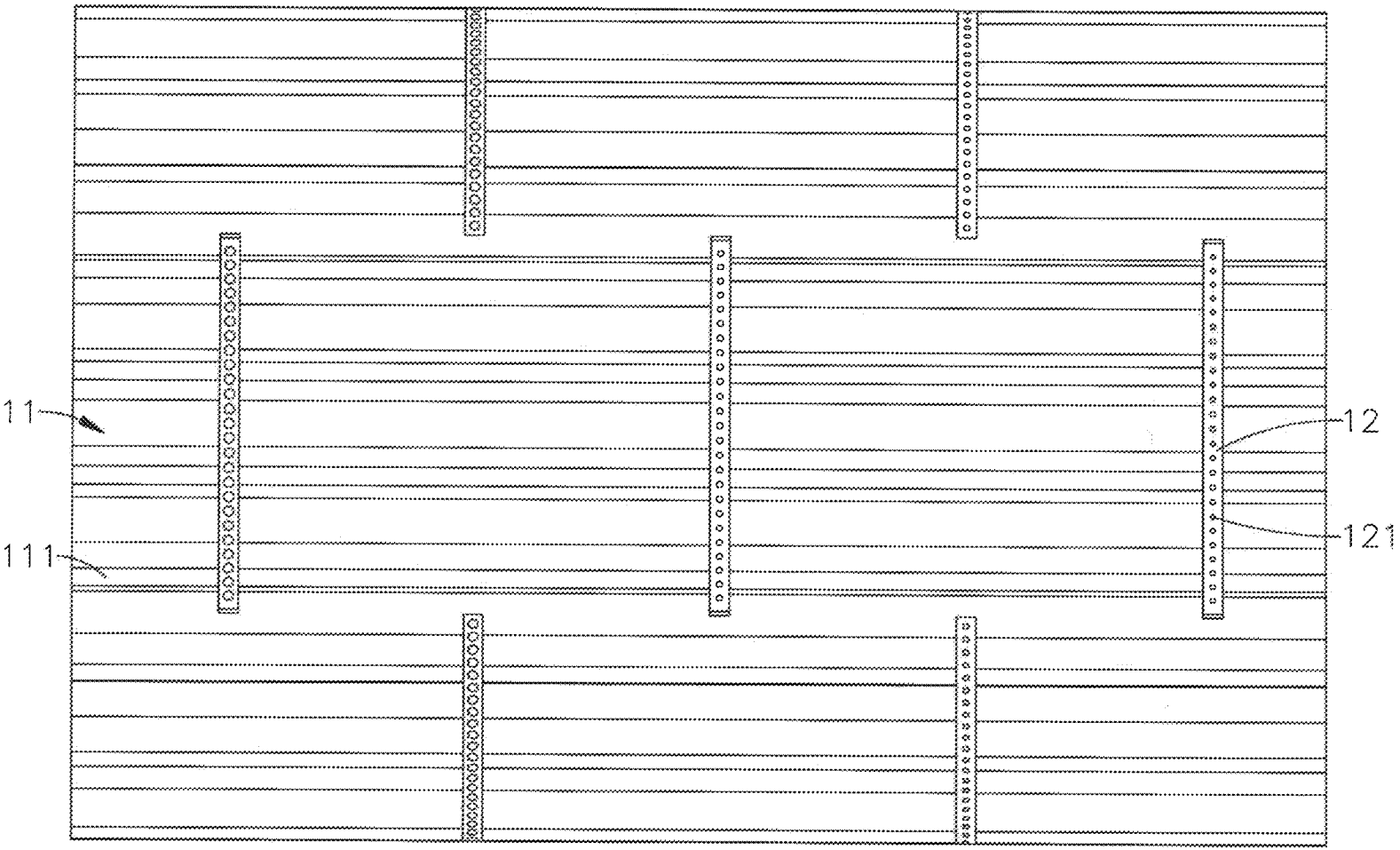
FIG. 5 is an enlarged view of a part of one ramming roller of the corrugated paper forming machine in accordance with the second embodiment of the present invention.

Referring to FIGS. 4 and 5, a schematic drawing illustrating a paper material delivered through two ramming rollers of a corrugated paper forming machine and rammed into shape in accordance with a second embodiment of the present invention and an enlarged view of a part of one ramming roller of the corrugated paper forming machine in accordance with the second embodiment of the present invention are shown. This second embodiment is substantially similar to the aforesaid first embodiment of the present invention with the exception that the air suction grooves 12 are arranged in straight rows and spaced around the periphery of each ramming roller 11 in a staggered manner and respectively perpendicularly extending across respective longitudinal teeth 111; the diameters of the air suction holes 121 in each air suction groove 12 of each ramming roller 11 is gradually reduced in direction from the middle part of each ramming roller 11 toward the two opposite ends thereof so that relatively larger suction force can be produced in the middle area of each ramming roller 11 than the two opposite end areas of each ramming roller 11.

Referring to FIGS. 1 through 5 again, the gear train (or belt wheels) of the motorized gear (or belt) transmission mechanism (not shown) of the corrugated paper forming machine 1 is started to rotate the two ramming rollers 11 in reversed directions, at the same time, a paper material 2 is being delivered through the gap 110 in between the two ramming rollers 11, and thus the paper material 2 is rammed by the teeth 111 of the two ramming rollers 11 into a fluted paper having flute design 21. During the ramming process, the suction motor 141 of the motor operated suction device 14 is operated to draw air out of the ramming rollers 11 through the air outlets 131 of the ventilation unit 13, causing generation of a suction force in the air suction grooves 12 to suck up the paper material 2 for ramming. In the operation, the control module 142 of the motor operated suction device 14 receives numerical sensing data from the paper width sensor 1431, temperature sensor 1432, speed sensor 1433 and humidity sensor 1434 of the sensor circuit 143 and computes the data to identify the operation conditions of the paper material 2 (such as paper width, working temperature, speed, humidity, etc.), and then compares the computed results with built-in reference data for the determination of the control of the operating speed of the suction motor 141, and thus, the suction force generated in the air suction grooves 12 is optimally controlled, eliminating power waste and saving power cost.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A corrugated paper forming machine, comprising:

at least one ramming roller rotatable to ram a paper material into a fluted paper having flute design, each said ramming roller comprising a plurality of longitudinal teeth equiangularly spaced around the periphery thereof, a plurality of air suction grooves located in the periphery, a ventilation unit formed of a plurality of air outlets and located in one end thereof, and a plurality of air suction holes located in said air suction grooves in communication with said air outlets;

a motor operated suction device comprising a suction motor connected with said ventilation unit and adapted for drawing air out of said at least one ramming roller to cause generation of a suction force in said air suction grooves;

a control module electrically coupled with said suction motor of said motor operated suction device; and a sensor circuit electrically coupled to said control module for sensing operation conditions of a paper material to be rammed by said ramming roller into a fluted paper and providing detected numerical data to said control module to regulate the speed of said suction motor in changing the level of suction force, wherein said sensor circuit comprises a paper width sensor, a temperature sensor, a speed sensor and a humidity sensor.

2. The corrugated paper forming machine as claimed in claim 1, wherein each said ramming roller comprises a plurality of longitudinal teeth equiangularly spaced around the periphery thereof for a paper material into a fluted paper having flute design; each said air suction grooves extends across a predetermined number of said longitudinal teeth.

3. The corrugated paper forming machine as claimed in claim 1, wherein said air suction holes in said air suction grooves in each said ramming roller are arranged in a line; the spacing between each two adjacent said air suction holes in each said air suction groove of each said ramming roller is gradually increased in direction from a middle part of each said ramming roller toward two opposite ends of each said ramming roller.

4. The corrugated paper forming machine as claimed in claim 1, wherein said air suction holes in said air suction grooves in each said ramming roller are arranged in a line; the diameter of said air suction holes in each said air suction groove of each said ramming roller is gradually reduced in direction from a middle part of each said ramming roller toward two opposite ends of each said ramming roller.

* * * * *